United States Patent [19]

Rees

[11] 4,347,810

[45] Sep. 7, 1982

[54] COMBUSTION CHAMBER WALL

[75] Inventor: Karl Rees, Ruti, Switzerland

[73] Assignee: Sulzer Brothers Limited, Winterthur, Switzerland

[21] Appl. No.: 300,662

[22] Filed: Sep. 9, 1981

Related U.S. Application Data

[63] Continuation of Ser. No. 104,427, Dec. 17, 1979, abandoned.

[30] Foreign Application Priority Data

Dec. 20, 1978 [CH] Switzerland ..... 12930/78

[51] Int. Cl.[3] ..... F22B 37/24

[52] U.S. Cl. ..... 122/6 A; 122/510; 122/512

[58] Field of Search ..... 122/6 A, 235 A, 235 C, 122/265, 512, 510

[56] References Cited

U.S. PATENT DOCUMENTS

| | | | |
|---|---|---|---|
| 3,164,137 | 1/1965 | Liessenberg | 122/6 A |
| 3,303,876 | 2/1967 | Berman et al. | 122/6 A |
| 3,357,408 | 12/1967 | Patterson | 122/6 A |
| 4,059,075 | 11/1977 | Ssinegunski et al. | 122/6 A |
| 4,123,994 | 11/1978 | Gersch et al. | 122/6 A |
| 4,175,519 | 11/1979 | Pratt et al. | 122/6 A |
| 4,276,930 | 7/1981 | Weber | 165/162 |
| 4,307,777 | 12/1981 | Chwyla | 165/162 |

FOREIGN PATENT DOCUMENTS

| | | | |
|---|---|---|---|
| 54-132003 | 10/1979 | Japan | 122/512 |

*Primary Examiner*—Henry C. Yuen

*Attorney, Agent, or Firm*—Kenyon & Kenyon

[57] ABSTRACT

The combustion chamber wall consists of tubes which are inclined to the horizontal and which are welded to one another in a gas-tight relationship via webs. Pairs of vertical tension strips bear against the outside of the combustion chamber wall. Each pair is connected to the wall tubes via a plurality of sheet-metal strips distributed over the height of the combustion chamber wall. The sheet-metal strips are disposed perpendicularly to the combustion chamber wall plane and are cut out in the form of a comb at the edge connected to the wall tubes.

7 Claims, 4 Drawing Figures

COMBUSTION CHAMBER WALL

This is a continuation of application Ser. No. 104,427 filed Dec. 17, 1979, now abandoned.

This invention relates to a combustion chamber wall. More particularly, this invention relates to a combustion chamber wall for a steam generator.

As is known, various types of walls have been utilized for the combustion chamber of a steam generator. For example, it has been known to construct a combustion chamber wall of horizontal or inclined wall tubes which are interconnected in gas-tight relationship by means of webs. It is also known to stengthen such walls by disposing pairs of tension strips vertically along and fixed to the outside of the webs such as described in U.S. Pat. No. 4,123,994. In this case, the tension strips are welded to the wall tube webs via bridge-like elements which are also spaced from the wall tubes.

However, in the event of a variation of temperature in the combustion chamber, the temperature of the tension strips follows only with a considerable delay. As a result, there are considerable transient thermal stresses in both the tension strips and in the combustion chamber wall.

Accordingly, it is an object of the invention to reduce transient tensile stresses in a combustion chamber wall in a structurally simple mamner.

It is another object of the invention to reduce the cost of constructing a combustion chamber wall.

It is another object of the invention to reduce the thermal inertia of a combustion chamber wall for a steam generator.

It is another object of the invention to be able to start up a steam generator more rapidly.

Briefly, the invention provides a combustion chamber wall which is comprised of a plurality of wall tubes each of which has a horizontal vector, that is the tubes are either horizontal or are inclined horizontally. In addition, the wall has a plurality of webs interconnecting the tubes in gas-tight relation and pairs of vertically disposed tension strips for strengthening the wall. In accordance with the invention, a plurality of comb-shaped sheet-metal strips are provided with at least two of the comb-shaped strips being vertically disposed between a respective pair of the tension strips in vertically spaced apart relation. In addition, each comb-shaped strip is secured to a plurality of wall webs in perpendicular relation thereto and is secured to each of the tension strips of the respective pair of tension strips with the tension strips in contact witt the wall tubes. This construction reduces the transient tensile stresses in the combustion chamber wall in a relatively simple constructional manner.

The combustion chamber wall may also have a plurality of U-shaped sections for buttressing the tension strips against the tube wall. To this end, each U-shaped section has a pair of limbs welded to each of two consecutively disposed webs and a web connecting the limbs and welded to a respective one of the tension strips of a pair of tension strips. In this way, the tension strips bear more tightly against the tube wall without considerable additional thermal stresses occurring in the tension strips or in the wall.

The combustion chamber wall may also comprise a plurality of vertical tubes which are connected together in gas-tight relation by vertical webs to define at least one wall of a gas flue extending upwardly from the wall tubes. In addition, the tension strips are provided with fork-like prongs which extend upwardly and laterally alongside the vertical tubes in secured relation thereto. In this way, the forces acting on the tension strips are divided up advantageously over the top part of the wall in which the tubes extend vertically.

A plurality of ribs may also be secured perpendicularly to the vertical web in the gas flue wall and may be fixed to the prongs. This provides for the transmission of tensile forces to the top part of the wall, i.e. to the gas flue, in a very simple structural manner.

These and other objects and advantages of the invention will become more apparent from the following detailed description and appended claims taken in conjunction with the accompanying drawings in which:

Figure 1:
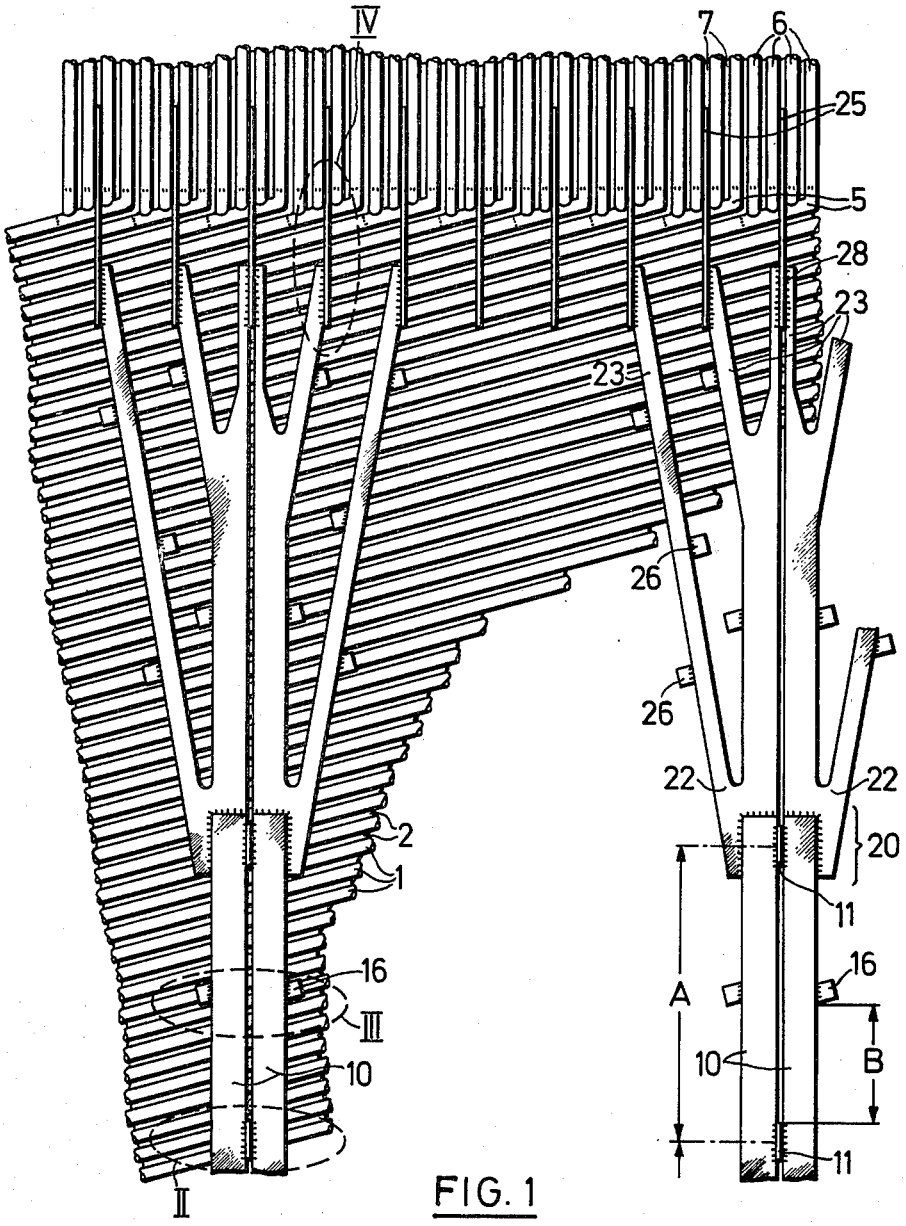
FIG. 1 illustrates a fragmentary view of the combustion chamber wall according to the invention as viewed from outside.

Referring to FIG. 1, the combustion chamber wall is comprised of a plurality of horizontally inclined wall tubes 1 which form a flat wall of a prismatic combustion chamber and which are welded together in gas-tight relation via a plurality of vertical webs 2. The various inclined wall tubes 1 are connected to distributors (not shown) at the bottom. In addition, the upper ends of the wall tubes 1 lead into distribution members 5, each of which has four connecting spigots disposed in the wall plane and extending upwardly. As shown, a plurality of vertical straight tubes 6 are welded to the spigots and are also interconnected in gas-tight relationship via vertical webs 7 so as to define at least one wall of a gas flue. The tubes 6 are situated in substantially the same plane as the inclined wall tubes 1 of the combustion chamber. The combustion chamber extends as far as the height of the distribution members 5 while the straight tube 6 line the gas flue which may contain platen or clustered heating surfaces.

During use, water flows through the tubes 1, 6 and may be completely or partially evaporated in the tubes 6. Combustion chamber walls of this kind are conventionally suspended at the top from a boiler frame so as to enclose a prismatic cavity. The walls are therefore subject to considerable tensile loading. While walls with vertical tubes take such vertical tensile forces without considerable stresses occurring therein, this is not the case with walls in which the tubes extend horizontally or at an angle. This is because appreciable bending stresses occur in the tubes.

Figure 2:
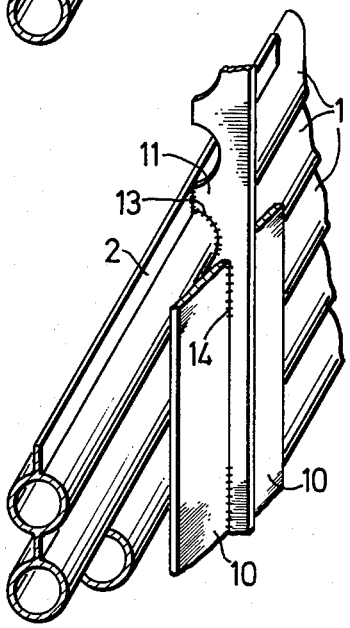
FIG. 2 illustrates a perspective view of a detail II of FIG. 1.

As shown in FIG. 1, a plurality of tension strips 10 are provided in pairs in vertical side by side relation in order to strengthen the tube walls. In addition, as shown in FIG. 2, a plurality of comb-shaped sheet-metal strips or plates 11 is provided for each pair of tension strips 10. As indicated, the sheet-metal strips 11 are vertically disposed between each pair of strips 10 in vertically spaced apart relation on a given pitch A. The sheet-metal strips 11 are disposed in perpendicular relation to the tube wall and are welded to the webs 2 by fillet welds 13. As indicated in FIG. 2, the tension strips 10 are welded to the sheet metal strips 11 by vertical fillet welds 14 and contact the wall tubes 1.

Figure 3:
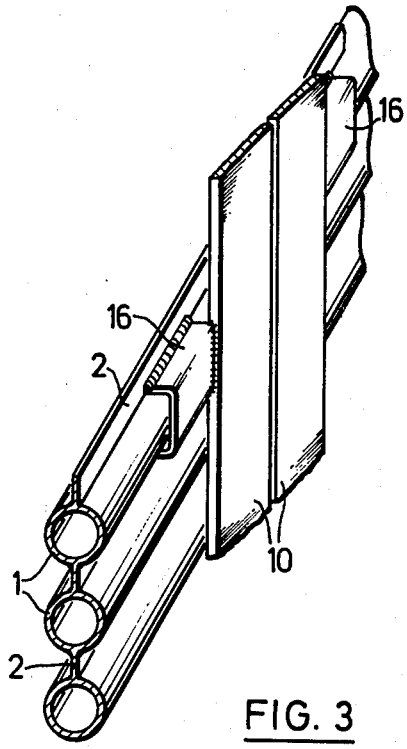
FIG. 3 illustrates a perspective view of a detail III of FIG. 1.

In the event of a rapid temperature rise in the combustion chamber wall, the tension strips 10 may lift away from the wall at the outer edges because of the temperature gradient occurring over their thickness. In this case, the heat transfer would deteriorate at those points. In order to obviate or reduce this effect, the outer edges of the tension strips 10 may be retained at mid height because the sheet-metal strips 11 by means of light weight U-shaped sections 16. As shown in FIG. 3, each U-shaped section 16 has a pair of limbs welded to each of two consecutively disposed webs 2 and a web connecting the limbs and welded to an outer edge of a respective one of the tension strips 10 of a given pair of tension strips 10. As indicated in FIG. 1, the distance B between the U-shaped section 16 and the sheet-metal strips 11 is made such that the transverse elongation of the tension strips 10 due to temperature differences does not give rise to any appreciable additional stresses. As shown, the sections 16 are at mid length of the tension strips 10.

Figure 4:
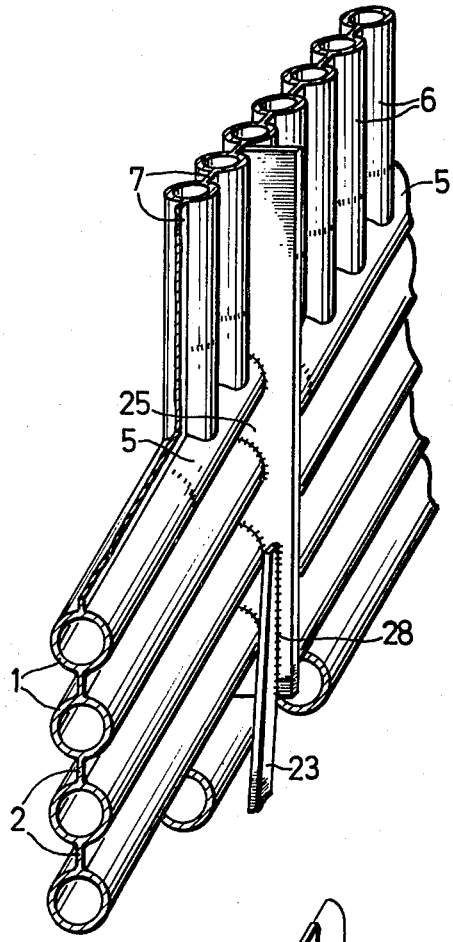
FIG. 4 illustrates a detail IV of FIG. 1.

Referring to FIG. 1, the tension strips 10 may also have fork-like prongs extending upwardly and laterally along side the vertical tubes 6 for supporting the wall tubes 1 from the wall of the gas flue. As shown in FIG. 1, forked strips 22 which are somewhat thinner than the tension strips 10 are welded to the tension strips 10 in a zone 20 and have prongs 23 extending upwardly therefrom. These prongs 23 are fixed to ribs 25 at the upper ends, as viewed, by fillet welds 28 (see FIG. 4). The ribs 25 are in turn secured perpendicularly to the vertical webs 7 by fillet welds. As indicated in FIG. 1, the forked strips 22 are connected to the webs 2 between the inclined wall tubes 1 by U-shaped sections 26. Alternatively, one or more sheet-metal strips 11 may also be provided in a manner similar to the above.

What is claimed is:

1. A combustion chamber wall comprising a plurality of wall tubes each having a horizontal vector;

a plurality of webs interconnecting said wall in gas-tight relation;

a plurality of vertical tubes;

vertical webs connecting said vertical tubes together in gas-tight relation to define at least one wall of a gas flue extending upwardly from said wall tubes;

pairs of vertically disposed tension strips in contact with said wall tubes and having fork-like prongs extending upwardly and laterally alongside said vertical tubes in secured relation thereto; and a plurality of comb-shaped sheet-metal strips, at least two of said sheet-metal strips being vertically disposed between and secured to a respective pair of said tension strips in vertically spaced apart relation, each said sheet-metal strip being secured to a plurality of said webs in perpendicular relation thereto.

2. A combustion chamber wall as set forth in claim 1 which further comprises a plurality of ribs secured perpendicularly to said vertical webs and fixed to said prongs.

3. A combustion chamber wall comprising a plurality of wall tubes each having an axis with a horizontal vector;

a plurality of webs interconnecting said wall tubes in gas-tight relation;

a gas tight wall of a gas flue extending upwardly from said wall tubes;

pairs of vertically disposed tension strips in contact with said wall tubes for supporting said wall tubes from said gas tight wall and to effect a heat transfer between said strips and said tubes; and a plurality of comb-shaped sheet-metal strips, at least two of said sheet-metal strips being vertically disposed between and secured to a respective pair of said tension strips in vertically spaced apart relation, each said sheet-metal strip being secured to a plurality of said webs in perpendicular relation thereto whereby said tension strips are held in contact with said wall tubes to follow variations of temperature in said wall tubes while reducing transient tensile stresses in said wall tubes.

4. In a steam generator having a combustion chamber wall comprising a plurality of inclined wall tubes; a plurality of vertical webs interconnecting said wall tubes in gas-tight relation; and a gas tight wall of vertical tubes extending upwardly from said wall tubes for supporting said wall tubes therefrom; the combination comprising pairs of vertically disposed tension strips alongside and in contact with said wall tubes to effect a heat transfer therebetween; and a plurality of comb-shaped sheet-metal strips, at least two of said strips being vertically disposed between each respective pair of said strips in vertically spaced relation, each said sheet-metal strip being secured to a respective pair of tension strips and to a plurality of said webs in perpendicular relation thereto whereby said tension strips are held in contact with said wall tubes to follow variations of temperature in said wall tubes while reducing transient tensile stresses in said wall tubes.

5. A combustion chamber wall as set forth in claim 3 wherein said tension strips are in side-by-side parallel relation and are welded to a respective comb-shaped strip.

6. A combustion chamber wall as set forth in claim 3 wherein each comb-shaped sheet-metal strip is welded to respective ones of said tubes.

7. A combustion chamber wall as set forth in claim 6 which further comprises a plurality of U-shaped sections, each said section having a pair of limbs welded to each of two consecutively disposed webs and a web connecting said limbs and welded to an outer edge of a respective one of said tension strips of a pair of tension strips, each said section being disposed at mid-length of said respective tension strip.

* * * * *

UNITED STATES PATENT AND TRADEMARK OFFICE

CERTIFICATE OF CORRECTION

PATENT NO. : 4,347,810

DATED : September 7, 1982

INVENTOR(S) : KARL REES

It is certified that error appears in the above—identified patent and that said Letters Patent is hereby corrected as shown below:

Column 1, line 28, change "mamner" to --manner--

Column 4, line 51, change "6" to --3--

Signed and Sealed this

*Twenty-third* Day of *November 1982*

[SEAL]

*Attest:*

GERALD J. MOSSINGHOFF

*Attesting Officer*

*Commissioner of Patents and Trademarks*